United States Patent [19]

Donald

[11] Patent Number: 4,576,894

[45] Date of Patent: Mar. 18, 1986

[54] TANNING DEVELOPMENT IN LOW SILVER PHOTOIMAGING USING POLYMERIC COUPLERS

[75] Inventor: Dennis S. Donald, Mendenhall, Pa.

[73] Assignee: E. I. Du Pont De Nemours and Company, Wilmington, Del.

[21] Appl. No.: 653,593

[22] Filed: Sep. 24, 1984

[51] Int. Cl.[4] ..... G03C 1/30; G03C 1/06; G03C 5/36; G03C 5/26

[52] U.S. Cl. ..... 430/264; 430/270; 430/381; 430/548

[58] Field of Search ..... 430/264, 270, 548, 381

[56] References Cited

U.S. PATENT DOCUMENTS

| | | | |
|---|---|---|---|
| 2,310,943 | 2/1943 | Dorough et al. | 260/73 |
| 2,397,864 | 4/1946 | Jennings et al. | 95/2 |
| 2,397,865 | 4/1946 | Jennings | 95/7 |
| 3,440,049 | 4/1969 | Moede | 96/66 |
| 3,904,418 | 9/1975 | Mowrey et al. | 96/73 |
| 4,137,080 | 1/1979 | Fujiwhara et al. | 96/55 |
| 4,211,561 | 7/1980 | Plambeck, Jr. | 430/306 |
| 4,335,197 | 6/1982 | Chambers et al. | 430/271 |
| 4,520,093 | 5/1985 | Chambers | 430/381 |

OTHER PUBLICATIONS

Tull, J. Photog. Sci. 24, 158 to 167 (1976).

"The Theory of the Photographic Process", Fourth Edition, edited by James, MacMillan Publishing Co., Inc., New York, 1977, pp. 326, 327, 347 and 348.

*Primary Examiner*—Richard L. Schilling

*Attorney, Agent, or Firm*—James A. Costello

[57] ABSTRACT

A photoimaging system and method for photoimaging employing said photoimaging system, the latter comprising (i) a photosensitive element having a substrate coated with a photosensitive layer containing dispersed silver halide particles in operative association with a continuous film-forming phase of polymeric coupler, the coupler characterized by the ability to couple with the developing agent of component (ii) to become insoluble in aqueous media; and (ii) an oxidized hydroquinone or aminophenol-type developing agent.

25 Claims, No Drawings

TANNING DEVELOPMENT IN LOW SILVER PHOTOIMAGING USING POLYMERIC COUPLERS

BACKGROUND OF THE INVENTION

This invention concerns an improvement in the methods for forming photoimages that are disclosed in U.S. Pat. Nos. 4,335,197 and 4,211,561. The improvement comprises insolubilizing the polymeric coupler with a hydroquinone or N-substituted aminophenol-type developing agent to produce washout images that are substantially colorless. Also of concern is a photosensitive element/developer system.

U.S. Pat. No. 4,335,197 discloses a method for producing a photopolymer image on a substrate which comprises exposing to actinic radiation a photosensitive layer containing dispersed silver halide in operative association with a multifunctional polymeric coupler, developing the latent image with a monofunctional developing agent, and removing the undeveloped, soluble portion by washing with aqueous solvent.

U.S. Pat. No. 4,211,561 discloses a method for producing a photopolymer image employing a multifunctional developing agent in place of the monofunctional developer of U.S. Pat. No. 4,335,197.

U.S. Pat. No. 2,310,943 describes the use of a polyvinyl acetal carrying phenolic color-former groups, dispersed in a gelatin/silver halide photographic emulsion.

U.S. Pat. Nos. 2,397,864 and 2,397,865 disclose acetals and related hydrophilic polymeric color-formers as the sole film-forming carrier for silver halide in a color film.

Procedures are known whereby exposed gelatin/silver halide layers are developed under conditions that cause tanning of the gelatin in the exposed areas. Such procedures have been used to prepare gelatin relief images in the imbibition printing of color pictures, e.g. Tull, J. Photog. Sci. 24, 158 to 167 (1976). Monofunctional developers are usually used as gelatin tanning agents in such procedures. U.S. Pat. No. 3,440,049 describes the use of bifunctional developing agents.

U.S. Pat. No. 3,904,418 discloses the use of a polymerized monomer containing at least one active methylene group as a component of a binding agent, useful in a photographic element adapted for silver-dye bleach processes.

U.S. Pat. No. 4,137,080 discloses a process for preparing color pictures by means of light-sensitive, photographic, silver halide reproducing materials in which development occurs with a polyfunctional developing agent in the presence of a polyfunctional coupler.

For a discussion of polymeric couplers and tanning development, see "The Theory of the Photographic Process", Fourth Edition, edited by James, Macmillan Publishing Co., Inc., New York, 1977, pages 326, 327, 347 and 348.

SUMMARY OF THE INVENTION

This invention concerns a photoimaging system comprising the components:

(i) a photosensitive element for photoimaging applications comprising a substrate coated with a photosensitive layer containing dispersed silver halide particles in operative association with a continuous film-forming phase of polymeric coupler, the coupler characterized by a number average molecular weight of about 2,000 to 100,000, a content of about 10 to 100 milliequivalents of coupler groups per 100 g of polymeric coupler and about 15 to 175 milliequivalents per 100 g of polymeric coupler of at least one acid group selected from carboxylic, sulfonic, and phosphonic, and the ability to couple with an oxidized hydroquinone or N-substituted aminophenol-type developing agent of component (ii) to become insoluble in aqueous media; and (ii) a hydroquinone or N-substituted aminophenol-type developing agent;

the system characterized further in that components (i) and (ii) cooperate to provide photoimages whose low inherent color will not complicate color generation and balancing using toners, pigments or dyes.

This invention also concerns an improved method for forming a photoimage, comprising:

(a) exposing, imagewise, a photosensitive element to actinic radiation, the element comprising a substrate coated with a photosensitive layer containing dispersed silver halide particles in operative association with a continuous film-forming phase of polymeric coupler, the coupler characterized by (i) a number average molecular weight of about 2,000 to 100,000;

(ii) a content of about 10 to 100 milliequivalents per 100 g of polymeric coupler of coupler groups and about 15 to 175 milliequivalents per 100 g of polymeric coupler of at least one of carboxylic, sulfonic, and phosphonic acid groups; and (iii) the ability to couple with an oxidized hydroquinone or N-substituted aminophenol-type developing agent to become insoluble in aqueous media;

(b) developing the layer containing the latent image with a developing agent capable of selectively reducing the silver halide in the latent image area and, in its oxidized state, of coupling with the polymeric coupler in the latent image area, thereby insolubilizing the coupler in the form of an image; and (c) removing the undeveloped, soluble areas of the polymeric coupler by washing with aqueous (solvent) media;

wherein the improvement comprises employing a hydroquinone or N-substituted aminophenol-type developing agent in step (b).

The improved (tanning) method of this invention produces washout images that are substantially colorless, a property which is particularly useful in colorproofing applications requiring a variety of techniques such as prepigmentation and custom toning.

It is preferred that the coupler comprising 30 to 80 meq per 100 g of polymeric coupler of coupler groups, and 20 to 165 meq per 100 g of polymeric coupler of carboxylic acid groups. Preferred couplers contain pyrazolone coupling groups and are between about 5,000 and 70,000 in molecular weight. Preferred developing agents are hydroquinone, N-methyl-p-aminophenol, catechol, and pyrogallol.

DETAILS OF THE INVENTION

The Substrate and Photosensitive Element

The photosensitive elements described herein comprise coatings applied to a wide variety of substrates. By "substrate" is meant any natural or synthetic support, preferably one which is capable of existing in a flexible or rigid film or sheet form. For example, the substrate can be glass, a metal sheet or foil such as copper, aluminum, or stainless steel; fiberboard; or a composite of two or more of these materials.

Other substrates include wood, cloth, and cellulose esters such as cellulose acetate, cellulose propionate, cellulose butyrate, and the like. Also suitable are films or plates composed of various film-forming synthetic resins or high polymers, such as the addition polymers, in particular the vinylidene polymers such as vinyl chloride polymers, vinylidene chloride copolymers with vinyl chloride, vinyl acetate, styrene, isobutylene, and acrylonitrile; vinyl chloride copolymers with the latter polymerizable monomers; linear condensation polymers including polyesters such as polyethylene terephthalate; polyamides such as polyhexamethylene sebacamide; polyester amides such as polyhexamethylene adipamide/adipate, and the like. Preferred substrates include oriented polyethylene terephthalate film, polyvinylidene chloride copolymer-coated oriented polyester film, and gelatin-colored oriented polyester film.

Fillers or reinforcing agents can be present in the synthetic resin or polymer bases, including synthetic, modified or natural fibers such as cellulosic fibers like cotton, cellulose acetate, viscose rayon and paper. Also useful are glass wool, nylon, and the like. These reinforced bases can be used in laminated form.

Choice of substrate will usually depend upon the use application involved. For example, the photosensitive elements of this invention, on oriented polyester film, are particularly useful in color-proofing systems and for the preparation of lithographic films.

The photosensitive elements will consist of one or more layers on the substrate. The element can also contain a top-coat or protective stratum. Such top-coats should be transparent to light and permeable to the basic developer solution, preferably soluble in an aqueous alkaline solution. The layer or layers are usually applied to the substrate as a solution or dispersion in a carrier solvent. The solution or dispersion can be sprayed, brushed, applied by a roller or an immersion coater, flowed over the surface, picked up by immersion, spin-coated, or applied to the substrate by other means. The solvent is then allowed to evaporate.

In general, solvents are employed which are volatile at ordinary pressures. Examples of suitable solvents include water, aqueous ammonia, aqueous solutions containing strongly basic organic amines, and mixtures of water with water-miscible organic solvents such as methanol, ethanol, butanol, 2-methoxyethanol, 2ethoxyethanol, 2-butoxyethanol, and the like. When the photosensitive element contains a separate silver halide layer, the polymeric coupler layer can be applied to the substrate using an organic solvent such as chlorinated hydrocarbons, ketones, or alcohols, and the silver halide emulsion is subsequently applied from an aqueous solution. Silver halide can also be applied from an alcohol dispersion by processes wherein silver halide emulsions in water are diluted with water miscible solvents like acetone to precipitate the emulsion binder, i.e., gelatin, around the AgX grains and hence break the emulsion. The gelatin coated AgX grains are then filtered and redispersed in alcohol with the assistance of, for example, salicyclic acid.

The thickness of the photosensitive element after drying, is usually about 0.02 to 0.3 mil (0.5 to 7.5 $\mu$m). This corresponds to a coating weight of about 5 to 80 mg/dm$^2$. When the photosensitive element is employed for the preparation of masking films such as lithographic films, it is preferred to use a coating weight of about 10 to 50 mg/dm$^2$. Such a coating weight represents a level of silver halide of about 4 to 22 mg/dm$^2$.

The Silver Halide

The light-sensitive halide used in the system and method of this invention to produce photoimages includes silver chloride, silver bromide, silver iodide, silver chlorobromide, silver iodobromide, and silver chloroiodobromide, either singly or in mixtures. Preparation of the halide can be carried out in the conventional manner in gelatin, or the halide can be formed directly in a solution of the polymeric coupler. The halide can be formed in gelatin, the gelatin removed, and the halide redispersed in a solution of the polymeric coupler. At least about two equivalents of silver halide per equivalent of coupler groups are employed. In imaging systems in which all of the silver halide present is not developable, more than about two equivalents of silver halide per equivalent of coupler groups may be needed, even up to about fifteen equivalents.

The grain size distribution and sensitization of the silver halide can be controlled to make silver halides suitable for all classes of photographic materials including general continuous tone, x-ray, lithographic, microphotographic, direct positive, and the like. Ordinarily, the silver halide dispersions will be sensitized chemically with compounds of sulfur, gold, rhodium, selenium, and the like. They can also be sensitized spectrally with various sensitizing dyes such as cyanine, 1,1′-diethyl-4,4′-cyanine iodide, 1,1′-diethyl-2,2′-carbocyanine iodide, 1′,3-diethylthia-4′-carbocyanine iodide and other methine and polymethine cyanine dyes, kryptocyanines, merocyanines, pseudocyanines, and others.

The Polymeric Coupler

The polymeric coupler is present as a continuous phase in operative association with silver halide particles which are dispersed in the polymeric coupler phase itself or in a layer of binder adjacent to the polymeric coupler phase. Such a binder layer is preferably a gelatin layer overlying the polymeric coupler phase. Minor amounts of gelatin can be present in the polymeric coupler phase so long as the coupler provides the continuous phase.

Polymeric coupler molecular weights (number average) vary between about 2,000 to 100,000 as determined by gel permeation chromatography. Specific molecular weights needed for various utilities can be determined by balancing the ease of washing out the soluble areas against the need for good mechanical properties. For example, low molecular weight acetoacetate polymeric couplers are more easily removed in the soluble areas after development, but the films tend to be somewhat weak. Alternatively, high molecular weight acetoacetate polymeric couplers give films of good mechanical properties, but the soluble areas are difficult to remove by washout. When a low molecular weight polymeric coupler is employed, it should contain a relatively low concentration of acidic groups so that imaged areas are sufficiently insoluble in aqueous solvents. Alternatively, when a high molecular weight polymeric coupler is used, a relatively high concentration of acidic groups may be required to provide adequate solubility of unimaged areas in aqueous solvents. Carboxyl groups are the preferred acidic groups.

The coupling of oxidized developer to coupler groups in basic solution provides for an effective solubility differential between developed and undeveloped polymeric coupler in aqueous solutions. For best results, it has been found that the minimum ratio of coupler groups to acidic groups should be about 10/175 and the maximum ratio should be about 100/15.

The coupler groups can be any coupler groups which are capable of coupling with an oxidized hydroquinone-type or N-substituted aminophenol-type developing agent. Useful coupler groups include those having the structure

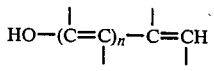

where n is 0 or 1. This structure is found in couplers which contain a reactive acyclic or intracyclic methylene group and in aromatic hydroxy compounds. These groups occur in phenols (including naphthols), amines, aminophenols, bis-phenols, acylacetarylides, cyanoacetarylides, beta-ketoesters, pyrazolones, N-homophthalylamines, coumaranones, indoxyls, thioindoxyls, and the like. The reaction groups can also be termed reactive methylene, reactive ethenol and reactive 4-hydroxy-1,3-butadienyl groups. In all of these coupler nuclei, the hydrogen atoms in the coupling position can be replaced by groups which are readily eliminated in the coupling reaction, including halogen such as Cl and Br, sulfonic acid, carboxylic acid, and the like. Pyrazolones are preferred coupler groups.

The coupler groups can be attached to any suitable base polymer so as to obtain the polymeric couplers useful in the invention. Preferred base polymers include copolymers of acrylic acid, methacrylic acid, methacrylamide, ethyl acrylate and 2-hydroxyethyl methacrylate with other conventional vinyl monomers.

Preparation of polymers which contain coupler groups is usually accomplished by copolymerization of an ethylenically unsaturated monomer which contains a coupler group such as 1-phenyl-3-methacrylamido-5-pyrazolone, or the acetoacetic ester of $\beta$-hydroxyethyl methacrylate, with such other monomers as methyl methacrylate, ethyl methacrylate, ethyl acrylate, propyl acrylate, methacrylic acid, acrylic acid, vinylphosphonic acid, vinylsulfonic acid, vinylbenzoic acid, p-vinylbenzenesulfonic acid, methacrylamide, 2-hydroxyethyl methacrylate, and the like, to provide polymers which contain pyrazolone groups or acetoacetate groups attached to the polymer chain. The pyrazolone coupler group can be attached to a polymer chain by reaction of 1-p-aminophenyl-3-methyl-5-pyrazolone with anhydride groups in a polymer chain, e.g., with a styrene/maleic anhydride copolymer. Other useful ethylenically unsaturated monomers which contain color-forming coupler groups are disclosed in British Pat. No. 875,248 and include m-methacrylamidophenol, 5-methacrylamido-1-naphthol, p-methacrylamidophenol, o-methacrylamidophenol, p-methacrylamidoaniline, p-methacrylamidophenylacetonitrile, 1-phenyl-3-methacrylamido-5-pyrazolone, 2,4-dimethacrylamidophenol, and m-methacrylamido-$\alpha$-benzoylacetanilide.

Coupler groups can be attached as lateral substituents on the main chain of a base polymer using such conventional chemical processes as esterification, amidation, etherification, acetal formation, and the like. Thus, preparation of polymers which contain ketomethylene coupler groups can be carried out by polymer substitution reactions. For example, reaction of ethyl acetoacetate with a carboxyl-containing polyvinyl alcohol in an ester exchange reaction gives a polymer which contains a plurality of ketomethylene groups. Similar reaction of carboxyl-containing polyvinyl alcohol with amino and hydroxy-substituted aromatic aldehydes gives polyvinyl acetals with attached coupler groups.

Introduction of acidic groups into the polymeric coupler is typically accomplished by copolymerization with an acidic group-containing monomer. Acidic groups can also be obtained by selective hydrolysis of ester groups attached to the polymer chain. The necessary acidic groups can also be introduced into a preformed polymer chain by sulfonation of preformed styrene copolymers.

In addition to the usual sensitizers and sensitizing dyes used for conventional silver halide emulsions, the polymeric coupler phase can contain dyes and pigments to provide the required optical density of the final image. Pigments such as carbon black are preferred when a very high optical density is required. The layer can also contain a colorless, transparent mordant for dyes. When a mordant is present, the insolubilized layer, after removal of soluble areas, can be treated with a dye solution to increase optical density as the dye is adsorbed by the mordant. Such a system avoids the loss of imaging speed which could be experienced if the dye or pigment is present in the photosensitive layer during exposure to radiation.

If an image of high optical density is required, say, in the preparation of litho film, the dye or pigment that provides the density can be incorporated in the polymeric coupler phase which can, in turn, be overcoated with a photosensitive silver halide layer. The silver halide is most conveniently carried out in an unhardened gelatin layer. With such an arrangement, essentially all of the light used for the exposure is available to the silver halide and none is lost by absorption by colorant. During development, the oxidized developing agent diffuses into the colored polymeric coupler phase to effect insolubilization.

U.S. Pat. No. 4,520,093 discloses a photosensitive element of the type described in paragraph (i) of the instant photoimaging system which has dispersed therein pigments of selected colors and concentrations to effect, upon photosensitization, a neutral black image characterized by an optical density imbalance of no more than about 0.5 and an optical density of at least about 2.0. Such element can be employed in the process of the instant invention using the tanning developing agents, i.e., a hydroquinone or N-substituted aminophenol-type developing agent, to give a neutral black image.

The photosensitive element can also contain various conventional photographic additives such as coating aids like saponin, alkylarylsulfonic acids or sulfoalkylsuccinic acids; plasticizers such as glycerol or 1,5-pentanediol; antistatic agents; agents to prevent the formation of spots, antihalation colorants; and the like.

The Developing Agent

The developing agent can be substituted or unsubstituted hydroquinone and N-substituted aminophenol types which are useful in conventional black and white photography. Suitable developing agents do not contain a primary amino group. In all cases however, at least two active coupling sites must be present in the developer. For example, although trimethylhydroquinone is an effective silver halide developing agent, it does not produce a tanned image. The developing agent contains a group capable of selectively reducing a silver halide latent image and (in its oxidized state) capable of reacting with the coupler groups of the polymeric coupler. The polymeric couplers are tanned (insolubilized) after exposure by treatment with the developing agent in basic solution. The acidic groups of the polymeric coupler, in both imaged and unimaged areas, are concurrently converted to ionic salt groups by reaction with base in the developer solution. Since the coupler groups are attached to the polymer chains, insolubilization of the polymer chains in aqueous solvents, in the imaged areas, takes place as a result of the coupling reaction.

Preferred developing agents include the hydroquinone-type, especially hydroquinone, methylhydroquinone, 2,6-dimethylhydroquinone, chlorohydroquinone, 2-methyl-3-chlorohydroquinone, dichlorohydroquinone, bromohydroquinone, hydroxyhydroquinone, sodium hydroquinone monosulfonate, pyrogallol, and catechol. Hydroquinone is particularly preferred. Preferred N-substituted aminophenol developers include N-methyl-p-aminophenol. For a further discussion of developer including hydroquinone-type developing agents see "The Theory of the Photographic Process" (cited above) pages 300 to 311.

Exposure Process Step (a)

Imagewise exposure of the photosensitive layer is conveniently carried out by exposing the layer by any of the usual procedures used with silver halide photographic materials, including camera, cathode ray tube, light emitting diode, projection, contact or laser processes. Laser imaging is best done with compositions using silver halide spectrally sensitized to the laser output wavelength. Spectral sensitizations can improve silver halide light absorption at desired wavelengths.

In most applications the original copy used for camera exposure will consist of black and white areas only; or, if used for contact or projection printing, it will consist of opaque and clear areas (process transparency). Exposures are normally made directly onto the photosensitive element. However, when high concentrations of colorant are present in the silver halide-containing layer, exposure may be made through a transparent substrate to provide proper anchorage of the image to the substrate. When the photosensitive element contains a pigmented polymeric coupler layer and a separate superior silver halide emulsion layer, exposure can be made directly onto the silver halide layer. If an appropriate concentration of light-absorbing dye or pigment is present throughout the thickness of the photosensitive element so that the light is attenuated as it passes through the element, exposures to continuous tone copy can be made through the transparent support. Alternatively, the exposed and developed layer can be transferred to another support before removing the undeveloped, soluble areas. The image obtained is of varying thickness and continuous tone.

Development Process Step (b)

The developer is usually employed as a solution comprising developing agent in water or water-soluble organic solvents. The developing agent can also be incorporated in the photosensitive element itself as a subcoating, topcoating, or it can be mixed with the polymeric coupler to provide an integral structure containing the developing agent. When the developing agent is incorporated in the photosensitive layer, it is generally advantageous to utilize a protected developer or developer precursor such as a masked developer, so that premature oxidation and reaction of the developer is prevented. Acid salts of some of the developing agents are also suitable. The developer solution can comprise an activator solution (for the developing agent) such as aqueous base.

The developer solutions can contain conventional additives. For example, alkaline agents such as sodium hydroxide, ammonium hydroxide, potassium carbonate, potassium bicarbonate, and sodium carbonate are useful as development accelerators. Sodium sulfite at levels below about 0.5% can be employed to improve storage stability. Conventional developer superadditives such as 1-phenyl-3-pyrazolidone can also be added. The superadditive can be added directly to the developer solution or it can be incorporated within the photosensitive element. Hydroxylamine and substituted hydroxylamines can also function as development accelerators in many instances. In a preferred composition, hydroxylamine is employed as a development accelerator and the ratio of developing agent to hydroxylamine is about 10:1 to 1:2.5, most preferably about 1:1.

Alternatively, when the developing agent is incorporated in the photosensitive element, the superadditive can be added to the activator solution. Sodium sulfate can be used as a swelling suppressant; hydroxylamine salts and sodium sulfite are used as antioxidants; antifoggants include 6-nitrobenzimidazole salts and alkali metal halides such as potassium bromide; solubilizing agents include benzyl alcohol, 2-ethoxyethanol, 2-methoxyethanol, 2-butoxyethanol and 2-(2-butoxyethoxy)ethanol. Water softeners, wetting agents, pH buffers and the like can also be present. The pH of the developer solutions is preferably about 9 to 12.5, most preferably about 9.4 to 11.5.

The pH and salt content of the developer solutions are adjusted so that swelling but not dissolution of the photosensitive layer occurs during the developing step. When a water-insoluble polymer coupler is used, the pH of the developer solution is increased and the salt concentration is adjusted so that swelling but not dissolution of the polymeric layer occurs.

The quantity of developing agent employed is not critical. When developer solutions are employed, the developing agent usually amounts to about 1 to 50 g/L of solution, preferably about 5 to 25 g/L. The ratio of developing agent to polyfunctional coupler is not critical, but sufficient developing agent should be present to effect satisfactory coupling and insolubilization. Preferably, at least about 1.0 mole of developing agent for each equivalent of coupler group is employed.

Washout Step (c)

The undeveloped, soluble areas of the polymeric coupler layers are removed by washing with water, an aqueous solution of solids such as alkali metal carbonate, hydroxides, silicates, phosphates, sulfates, and halides, or a semiaqueous solution of water and a water-miscible organic solvent. Suitable organic solvents include methanol, ethanol, 2-propanol, 2-ethoxyethanol, 2-butoxyethanol, 2-(butoxyethoxy)ethanol, and glycerol. Spray washout and brushing are preferred for removal of the undeveloped areas. When a separate silver halide emulsion layer is employed, this entire layer can be removed during the washing step.

For certain applications, one or more conventional finishing steps can be included. Such steps include fixing after development or before or during washout, treatment with an oxidizing agent, acid treatment, hardening with polyvalent metal ions such as calcium, magnesium or borate ions, treatment with surface active agent, and the like. The element is dried in a conventional manner.

The process of this invention provides a water-insoluble polymeric relief image with good resolution over a wide range of exposure speeds including camera speeds. In addition, the process is operable with silver halide coating weights as low as about 2 mg/dm$^2$. The process is applicable for a wide variety of uses, but it is particularly useful for the preparation of lithographic films and proofing films where an image of low inherent color is desirable so as not to complicate color production and balancing using, for example, toners or pigments or dyes.

The process of the invention can be employed for the preparation of both negative and positive images. In the preparation of a negative image, the areas insolubilized correspond to the areas exposed to light, whereas for a positive image, the areas insolubilized correspond to the unexposed areas. The type of image obtained depends on the character of the silver halide used. Thus, a normal negative-working silver halide yields a negative polymer image while a positive-working silver halide, such as one prepared by well-known solarization or chemical fogging techniques, yields a positive polymer image.

In the following illustrative Examples of the invention all parts and percentages are by weight and all degrees are Celsius unless otherwise noted.

EXAMPLE 1

The Photosensitive Element

A. Preparation of Pyrazolone Polymeric Coupler

An acrylic copolymer containing pyrazolone coupler groups was prepared by heating at reflux for 8 hours a t-butyl alcohol solution of a mixture of 10 parts of methacrylic acid, 35 parts of methyl methacrylate, 43 parts of ethyl acrylate and 12 parts of 1-phenyl-3-methylacrylamido-5-pyrazolin-2-one in the presence of azobisisobutyronitrile initiator. The solution was poured into water to precipitate the copolymer and the precipitated copolymer was steamed to remove volatiles. The number average molecular weight measured by gel permeation chromatography was found to be approximately 70,000 using poly(methyl methacrylate) standards. A polymer solution was prepared by dissolving 10 g of the polymer in a mixture of 70 mL of distilled water and 1.25 mL of concentrated ammonium hydroxide.

B. Emulsion Preparation and Coating

A coating formulation was prepared under photographic safelights by mixing 41 g of the polymer solution of Part A with 50 g of a silver halide dispersion in water (10% solids) consisting of orthosensitized, negative-working $AgBr_{0.985}I_{0.015}$ grains with an average equivalent edge length of 0.28 μm (0.02 μm$^3$ volume). The coating formulation was coated onto a 25 μm oriented polyester film using a doctor knife. The coating was dried under a stream of warm air to give a photosensitive element with a coating weight of about 30 mg/dm$^2$.

Exposure and Development

The coated films were contact-exposed (vacuum frame) for 5 sec through a $\sqrt{2}$ step wedge process transparency using an incandescent lamp (10 ft-candles (108 lm/m$^2$) at 30.5 cm) placed 1.4 m from the film surface.

After exposure, the films were immersed in Developer A solution for 2 min at 26°. After development, the films were spray-washed with an air/water spray from a paint sprayer gun at about 275 kPa to remove unexposed areas, and then stopped in 2% aqueous acetic acid for 1 min. The films were air-dried. The developed image, having a $D_{max}$ of 0.72, was laminated (about 50% transfer) to an anodized aluminum surface at 122°.

| Developer A | |
|---|---|
| potassium carbonate | 5.4 g |
| potassium bicarbonate | 5.4 g |
| hydroquinone | 1.0 g |
| 2-phenyl-4-methyl-4-hydroxymethyl-5-pyrazolidone (PMHMP) | 0.01 g |
| sodium sulfite | 0.05 g |
| potassium bromide | 0.01 g |
| distilled water to make 100 mL solution. | |

EXAMPLES 2A, 2B AND 2C

The photosensitive element of Example 1 was exposed through a process transparency which contained 2%, 5%, 50%, 95% and 98% 150 line halftone dots for periods from 2 to 15 sec using an incandescent lamp as described in Example 1. After exposure, the films were developed in Developer B solution for times of either 1 min or 2 min at 26°. The developed films were washed, fixed, and dried as described. The results are summarized in the Table.

| Developer B | |
|---|---|
| potassium hydroxide | 5.4 g |
| potassium carbonate | 5.4 g |
| sodium sulfite | 0.05 g |
| potassium bromide | 0.011 g |
| hydroquinone | 0.1 g |
| PMHMP | 0.01 g |
| distilled water to make 100 mL solution. | |

TABLE

| Example | Exposure Time, Sec. | Development Time, Min. | Comments |
|---|---|---|---|
| 2A | 2 | 2 | 98% dots holes plugged |
| 2B | 2 | 1 | Good image; $D_{max}$ 0.6 |
| 2C | 4 | 1 | Good image; $D_{max}$ 1.1 |

EXAMPLE 3

This Example demonstrates the addition of hydroxylamine hydrochloride to the developer solution. Although an initial induction period of about 90 seconds is observed, once started the rate of development is rapid. The developed film has greatly improved washout properties. The induction period can be reduced by the addition of PMHMP to the developer solution at a concentration of about 0.05 g/L to 1.1 g/L, preferably about 0.1 g/L.

In this Example, the photosensitive element of Example 1 was exposed, developed and processed as described in Example 1 except that Developer A was replaced with Developer C. An induction time of about 30 sec was observed. At an exposure time of 2 sec with a 30 to 60 sec development time, excellent images were obtained. The developed image (60 sec development time) had a $D_{max}$ of 2.

| Developer C | |
|---|---|
| Reagents were added in the order shown. | |
| distilled water | 600 mL |
| potassium carbonate | 54.0 g |
| potassium bicarbonate | 54.0 g |
| hydroxylamine hydrochloride | 10.0 g |
| potassium bromide | 0.10 g |
| sodium sulfite monohydrate | 0.50 g |
| hydroquinone | 10.0 g |
| PMHMP | 0.11 g |
| distilled water to make 1L solution. | |

EXAMPLE 4

The Photosensitive Element

A. Preparation of Acetoacetate Polymeric Coupler

Acrylate copolymer containing an acetoacetic ester coupler was prepared in the following manner. A solution of 17.5 parts of methyl methacrylate, 21.5 parts of ethyl acrylate, 5.0 parts of methacrylic acid, and 5.4 parts of the acetoacetic ester of 2-hydroxyethyl methacrylate in 333 mL of t-butyl alcohol was heated at reflux. Azobisisobutyronitrile was added in four 0.01 part portions at one hour intervals, ending finally with one hour at reflux. The viscous polymer solution was added in small portions to ice in a blender mixed vigorously, and filtered. After air-drying there was obtained 23.2 g of white, free-flowing polymer. The number average molecular weight was found to be 94,300 by gel permeation chromatography using poly(methyl methacrylate) standards. The inherent viscosity measured in 90% formic acid/water was 0.548 DL/G.

B. Emulsion Preparation and Coating

A coating formulation of the polymeric coupler of Part A was prepared as described for the coupler of Example 1 by dissolution of the polymer in aqueous ammonium hydroxide with subsequent mixing of this polymer solution with the silver halide dispersion. The coating formulation was coated onto a 102-μm oriented polyester film having a subcoating of gelatin which had been hardened, and which contained an antihalation backing layer. The dried film contained a coating weight of about 20 mg/dm$^2$.

Exposure and Development

The dried films were exposed, developed in Developer C, washed out and stopped using the general procedure described for the films of Example 1. With an exposure time of 18 sec and 60 sec development, a good washout image with $D_{max}$=0.6 was obtained.

EXAMPLE 5

A photosensitive element was prepared by the procedure described in Example 1 to give an element with a coating weight of about 35 mg/dm$^2$. Coated films were exposed, developed in Developer D, washed out and stopped using the general procedure described for the films of Example 1. With an exposure time of 1 sec and 30 sec development, the image had good wet strength during washout; $D_{max}$=0.85.

| Developer D | |
|---|---|
| Reagents were added in the order shown. | |
| distilled water | 600 mL |
| potassium carbonate | 54.0 g |
| potassium bicarbonate | 54.0 g |
| hydroxylamine hydrochloride | 10.0 g |
| sodium sulfite | 0.50 g |
| potassium bromide | 0.10 g |
| catechol | 10.0 g |
| PMHMP | 0.11 g |
| distilled water to make 1 L solution. | |

EXAMPLE 6

The Photosensitive Element

A. Preparation of Pyrazolone Polymeric Coupler

A solution of 50 parts of methacrylic acid, 60 parts of 1-phenyl-3-methacrylamido-5-pyrazolin-2-one, 175 parts of methyl methacrylate, 215 parts of ethyl acrylate and 3333 parts of t-butyl alcohol was heated at reflux. Azobisisobutyronitrile was added in four 0.10 part portions at one hour intervals, ending finally with one hour at reflux. The viscous polymer solution was added in small portions to ice in a blender, mixed vigorously and filtered. After air drying, there was obtained 281 g of white, free-flowing polymer. The number average molecular weight was found by gel permeation chromatography to be 69,600 using poly(methyl methacrylate) standards.

B. Emulsion Preparation and Coating

A coating formulation of the polymeric coupler of Part A was prepared as described for the coupler of Example 1 by dissolution of the polymer in aqueous ammonium hydroxide with subsequent mixing of this polymer solution with the silver halide dispersion. The coating formulation was coated onto a 102-μm gelatin-subbed oriented polyester film substrate which contained an antihalation backing layer. The dried film contained a coating weight of about 50 mg/dm$^2$.

Exposure and Development

The dried films were exposed through a 2 to 98% halftone dot process transparency, developed in Developer E, washed out, and stopped for 32 sec in 2% aqueous acetic acid using the general procedure described for the films of Example 1. With an exposure time of 0.5 sec and 5 sec development, a good image with 2 to 98%, 150 line/in halftone dots, was obtained. The wet strength during processing was excellent as was the dry scratch resistance. In a second experiment it was found that PMHMP is not required in the developer solution to obtain a good image.

| Developer E | |
|---|---|
| Reagents were added in the order shown. | |
| distilled water | 600 mL |
| potassium carbonate | 54.0 g |
| potassium bicarbonate | 54.0 g |
| hydroxylamine hydrochloride | 10.0 g |
| potassium bromide | 0.10 g |
| sodium sulfite monohydrate | 0.50 g |
| N—methyl-p-aminophenol | 10.0 g |

-continued

| Developer E | |
|---|---|
| PMHMP | 0.11 g |
| distilled water to make 1 L solution. | |

EXAMPLE 7

This Example demonstrates incorporation of the developer within the photosensitive element. To 10 g of the silver halide-containing coating formulation prepared as described in Part B of Example 1 was added 60 mg of hydroquinone, and the resulting coating formulation was immediately coated onto a 102-μm gelatin-subbed oriented polyester film substrate which contained an antihalation backing layer.

The dried element was exposed through a 2 to 98% halftone dot process transparency for 1 sec, treated for 30 sec with Activator (solution) A, washed, and stopped for 30 sec in 2% aqueous acetic acid using the general procedure described for the films of Example 1. The resulting image was easily washed out, had good wet strength, and excellent dry scratch resistance. Resolution was very good; 2 to 98% 150 line/in halftone dots were present.

| Activator A | |
|---|---|
| distilled water | 800 mL |
| potassium carbonate | 387 g |
| potassium hydroxide | 112 g |
| sodium sulfite | 9.0 g |
| potassium bromide | 0.90 g |
| phenylmercaptotetrazole sodium salt | 0.28 g |
| benzotriazole | 1.06 g |

EXAMPLE 8

This Example demonstrates the preparation and use of a two-layer photosensitive element.

A. Emulsion Preparation and Coating

A solution of 5.0 g of the pyrazolone polymeric coupler of Example 6 in 35 mL of water and 0.75 mL of concentrated ammonium hydroxide was prepared. To a portion of this polymer solution was added sufficient 7.5% aqueous solution of N-methyl-p-aminophenol sulfate to give about 0.8% based on total solids. This developer-incorporated polymer solution was coated onto a 102-μm gelatin-subbed oriented polyester film substrate which contained an antihalation backing layer. Onto the dried film was overcoated a standard silver halide/gelatin emulsion layer to give a silver halide coating weight of 17 mg/dm$^2$.

B. Exposure and Development

The dried element was exposed through a 2 to 98% halftone dot process transparency for 3 sec, treated for 30 sec with Activator (solution) B, washed, and stopped for 1 min in 2% aqueous acetic acid using the general procedure described for the films of Example 1. A virtually colorless image was obtained; density of about 0.03 compared with a density of about 0.01 for the film substrate.

| Activator B | |
|---|---|
| potassium carbonate | 5.0 g |
| potassium bicarbonate | 5.0 g |

-continued

| Activator B | |
|---|---|
| hydroxylamine hydrochloride | 1.0 g |
| potassium bromide | 0.01 g |
| sodium sulfite | 0.05 g |
| distilled water to make 100 mL solution. | |

EXAMPLE 9

A coating formulation, prepared as described in Part B of Example 1, was coated onto a 102-μm gelatin-subbed oriented polyester film substrate which contained an antihalation backing layer. The dried film contained a coating weight of about 50 mg/dm$^2$. The dried element was exposed for 10 sec, treated for 1 min in Developer F, washed, and stopped for 1 min in 2% aqueous acetic acid using the general procedure described for the films of Example 1. The resulting image had good dry scratch resistance. Developer F was the same as Developer C except that the hydroquinone was replaced with 10 g of pyrogallol.

EXAMPLE 10

To 10 g of the silver halide-containing coating formulation prepared as described in Part B of Example 1 was added 60 mg of catechol, and the resulting coating formulation was coated onto a 102-μm gelatin-subbed oriented polyester film substrate which contained an antihalation backing layer. The dried film contained a coating weight of about 50 mg/dm$^2$.

The dried element was exposed through a 2 to 98% halftone dot process transparency for 1 sec, treated for 10 sec with Activator (solution) A, washed, and stopped for 1 min in 2% aqueous acetic acid using the general procedure described for the films of Example 1. The resulting image had excellent wet strength and resolution and acceptable dry scratch resistance; 1 to 99% line/in halftone dots were present.

The embodiments of the invention in which an exclusive property or privilege is claimed are defined as follows:

1. A photoimaging system comprising the components:

(i) a photosensitive element for photoimaging applications comprising a substrate coated with a photosensitive layer containing dispersed silver halide particles in operative association with a continuous film-forming phase of polymer coupler, the coupler characterized by a number average molecular weight of about 2,000 to 100,000, a content of about 10 to 100 milliequivalents of coupler groups per 100 g of polymeric coupler and about 15 to 175 milliequivalents per 100 g of polymeric coupler of at least one acid group selected from carboxylic, sulfonic, and phosphonic, and the ability to couple with an oxidized developer of component (ii) to become insoluble in aqueous media; and (ii) a developer consisting essentially of catechol, pyrogallol, or a hydroquinone or N-substituted aminophenol-type developing agent having at least two active coupling sites;

the system characterized further in that components (i) and (ii) cooperate to provide photoimages that are substantially colorless.

2. A photoimaging system according to claim 1 wherein the coupler groups have the structure

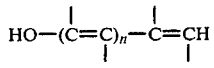

wherein n is 0 or 1.

3. A photoimaging system according to claim 2 wherein the polymeric coupler comprises acetoacetate coupling groups.

4. A photoimaging system according to claim 2 wherein the polymeric coupler comprises pyrazolone coupling groups.

5. A photoimaging system according to claim 4 wherein the molecular weight of the polymeric coupler is about 5,000 to 70,000.

6. A photoimaging system according to claim 5 wherein the coupler comprises 30 to 80 meq per 100 g of polymeric coupler of coupler groups, and 20 to 165 meq per 100 g of polymeric coupler of carboxylic acid groups.

7. A photoimaging system according to claim 1 wherein the developing agent is selected from hydroquinone, catechol, N-methyl-p-aminophenol and pyrogallol.

8. A photoimaging system according to claim 7 wherein the developing agent is hydroquinone.

9. A photoimaging system according to claim 2 wherein the developing agent is selected from hydroquinone, catechol, N-methyl-p-aminophenol and pyrogallol.

10. A photoimaging system according to claim 3 wherein the developing agent is selected from hydroquinone, catechol, N-methyl-p-aminophenol and pyrogallol.

11. A photoimaging system according to claim 4 wherein the developing agent is selected from hydroquinone, catechol, N-methyl-p-aminophenol and pyrogallol.

12. A photoimaging system according to claim 6 wherein the developing agent is selected from hydroquinone, catechol, N-methyl-p-aminophenol and pyrogallol.

13. A photoimaging system according to claim 9 wherein the developing agent is hydroquinone.

14. A photoimaging system according to claim 12 wherein the developing agent is hydroquinone.

15. A photoimaging system according to claim 1 including, additionally, hydroxylamine as a development accelerator.

16. An improved method for forming a photoimage comprising:

(a) exposing, imagewise, a photosensitive element to actinic radiation, the element comprising a substrate coated with a photosensitive layer containing dispersed silver halide particles in operative association with a continuous film-forming phase of polymeric coupler, the coupler characterized by (i) a number average molecular weight of about 2,000 to 100,000;

(ii) a content of about 10 to 100 milliequivalents per 100 g of polymeric coupler of coupler groups and about 15 to 175 milliequivalents per 100 g of polymeric coupler of at least one of carboxylic, sulfonic, and phosphonic acid groups; and (iii) the ability to couple with an oxidized developer consisting essentially of catechol, pyrogallol, or a hydroquinone or N-substituted aminophenol-type developing agent having at least two active coupling sites, to become insoluble in aqueous solvents;

(b) developing the layer containing the latent image with a developer capable of selectively reducing the silver halide in the latent image area and, in its oxidized state, of coupling with the polymeric coupler in the latent image area, thereby insolubilizing the coupler in the form of an image; and (c) removing the undeveloped, soluble areas of the polymeric coupler by washing with aqueous solvent;

wherein the improvement comprises employing a developer consisting essentially of catechol, pyrogallol, or a hydroquinone or N-substituted aminophenol-type developing agent having at least two active coupling sites in step (b).

17. A method according to claim 16 wherein the developing agent is selected from the group consisting essentially of substituted and unsubstituted hydroquinone and N-substituted aminophenol.

18. A method according to claim 17 wherein the developing agent is selected from hydroquinone, catechol, N-methyl-p-aminophenol and pyrogallol.

19. A method according to claim 16 wherein the coupler groups have the structure

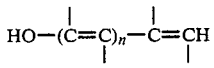

wherein n is 0 or 1.

20. A method according to claim 19 wherein the coupler comprises acetoacetate coupler groups.

21. A method according to claim 19 wherein the coupler comprises pyrazolone coupler groups.

22. A method according to claim 21 wherein the molecular weight of the polymeric coupler is about 5,000 to 70,000.

23. A method according to claim 22 wherein the coupler comprises 30 to 80 meq per 100 g of polymeric coupler of coupler groups, and 20 to 165 meq per 100 of polymeric coupler of carboxylic acid groups.

24. A method according to claim 16 employing hydroxylamine as a developing accelerator.

25. A substantially colorless photoimage made by the method of claim 16.

* * * * *